United States Patent [19]

Gosslar et al.

[11] Patent Number: 4,937,495

[45] Date of Patent: Jun. 26, 1990

[54] ELECTRODE STRUCTURE FOR SINGLE ENDED HIGH PRESSURE DISCHARGE LAMP

[75] Inventors: Achim Gosslar; Jürgen Heider, both of Munich, Fed. Rep. of Germany

[73] Assignee: Patent-Treuhand Gesellschaft fur elektrische Gluhlampen m.b.H., Munich, Fed. Rep. of Germany

[21] Appl. No.: 298,271

[22] Filed: Jan. 13, 1989

Related U.S. Application Data

[63] Continuation of Ser. No. 120,946, Nov. 16, 1987, abandoned.

[30] Foreign Application Priority Data

Dec. 1, 1986 [DE] Fed. Rep. of Germany ..... 3640990

[51] Int. Cl.[5] ..... H01J 61/04

[52] U.S. Cl. ..... 313/631; 313/43; 313/335; 313/620; 313/621; 313/633

[58] Field of Search ..... 313/39, 335, 352, 574, 313/620, 621, 631, 633, 43

[56] References Cited

U.S. PATENT DOCUMENTS

| | | | |
|---|---|---|---|
| 1,655,488 | 1/1928 | Wolff et al. | 313/569 |
| 2,459,579 | 1/1949 | Noel | 313/631 X |
| 2,662,196 | 12/1953 | Buckingham | 313/335 |
| 2,697,183 | 12/1954 | Neunhoeffer et al. | 313/570 |
| 3,625,068 | 7/1972 | Strauss | 313/335 X |
| 4,038,579 | 7/1977 | Ekkelboom | 313/335 X |
| 4,320,322 | 3/1982 | Rothwell, Jr. et al. | 313/621 |
| 4,633,136 | 12/1986 | Fromm et al. | 313/623 |

FOREIGN PATENT DOCUMENTS

| | | | |
|---|---|---|---|
| 1126531 | 11/1956 | France | 313/631 |
| 242736 | 2/1987 | German Democratic Rep. . | |
| 11677 | 1/1977 | Japan | 313/631 |
| 476833 | 12/1937 | United Kingdom | 313/631 |
| 2072412 | 9/1981 | United Kingdom . | |
| 2126415 | 3/1984 | United Kingdom . | |

OTHER PUBLICATIONS

Carless et al.; Lamps and Lighting, 3rd ed.; 1983, pp. 169–172.

"Electrode Development for Small Halogen Metal Vapor Lamps", published in Technisch-wissenschaftliche Abhandlugen der OSRAM-Gesellschaft (Technological and Scientific Discussions of the OSRAM Company), vol. 12, pp. 65–72 et seq. published by Springer, Berlin, 1986, Fromm et al.

*Primary Examiner*—Donald J. Yusko
*Assistant Examiner*—Michael Horabik
*Attorney, Agent, or Firm*—Frishauf, Holtz, Goodman & Woodward

[57] ABSTRACT

To improve the heat distribution of the electrodes within a high-pressure discharge vessel, particularly a vehicle (1) of quartz glass having a fill of mercury, a noble gas, and an additive which includes a metal or metal halide, especially, for good color rendition, tin which attacks the electrodes, the electrodes (4, 5) are pinch-sealed through the quartz glass envelope and include a parallel shaft portion (15, 17, 21) to which pin elements (16, 18, 19) are attached, for example by welding, which have a cross-sectional area larger, preferably by a factor of between 1.5 to 3, than the cross-sectional area of the shaft portion, to obtain high heat capacity of the electrodes while minimizing heat transfer to the pinch or press seal of the electrodes through the quartz glass vessel (2) via the shaft portions.

20 Claims, 2 Drawing Sheets

ELECTRODE STRUCTURE FOR SINGLE ENDED HIGH PRESSURE DISCHARGE LAMP

This application is a continuation of application Ser. No. 07/120,946, filed Nov. 16, 1987 now abandoned.

REFERENCE TO RELATED LITERATURE

U.S. Pat. No. 4,320,322 (to which British Patent 2,072,412, corresponds) Rothwell et al; British Patent 2,126,415, Dobrusskin et al, assigned to the assignee of the present application; U.S. Pat. No. 4,633,136, Fromm et al, assigned to the assignee of the present application. U.S. Ser. No. 802,073, filed Nov. 26, 1985 (Continuation of Ser. No. 515,387, filed July 20, 1983) Dobrusskin, Heider and Gosslar, assigned to the assignee of this application (to which German OS 32 32 207 corresponds), the disclosure of which is hereby incorporated by reference.

Article by D. C. Fromm, of the staff of a related company of the assignee of the present application, entitled, in translation, "Electrode Development for Small Halogen Metal Vapor Lamps", published in Technisch-wissenschaftliche Abhandlungen der OSRAM-Gesellschaft (Technological and Scientific Discussions of the OSRAM company), vol. 12, page 65 et seq., published by Springer, Berlin, 1986.

The present invention relates to high-pressure discharge lamps, and more particularly to single-ended high-pressure discharge lamps of low power, that is, power ratings between 35 to 150 W, for example.

High-pressure discharge lamps to which the present invention relates are described, for example, in British Patent 2,126,415, Dobrusskin et al, assigned to the assignee of the present application, and U.S. Pat. No. 4,320,322 (to which British 2,072,412, Rothwell, corresponds). These patents describe high-pressure discharge lamps in which electrodes have end portions which extend at a right angle with respect to the electrode shafts which are retained in a pinch or press seal in the discharge vessel, the end portions facing each other. The U.S. Pat. No. 4,320,322 describes inter alia electrodes in which the end portions are angled off from the shaft portions of the electrode by angles which can be as small as 20°, up to a right angle, that is, about 90°, with an angle of about 45° being preferred. The entire electrode is made of a single piece of wire. By angling off the tip of the electrode with respect to the straight shaft, stability of the arc which is formed within the discharge vessel is intended to be improved.

The lifetime of such lamps is limited by the attack of the aggressive fill which is customary in such lamps on the electrodes. Rapid corrosion of the electrode results. This problem is particularly annoying if the fill has a high proportion of tin halides. Failure of the lamp due to corrosion of electrodes can be delayed by using a thick electrode wire. This, however, substantially impairs the ignition behavior of the lamp—see, for example, the cited literature reference, article by D. C. Fromm.

THE INVENTION

It is an object to improve metal halide discharge lamps, and particularly to improve the lifetime of such lamps, without impairing the ignition characteristics and, preferably, improving the ignition characteristics of such lamps, especially if the lamp is already hot.

Briefly, the high-pressure discharge lamp, particularly a low-power lamp, that is, in the order of between about 35 to 150 W rating, has a discharge vessel made of quartz glass which, frequently, is in form of an ellipsoid. A pair of electrodes extend into the vessel which have generally parallel shaft portions sealed through a pinch or press seal of the vessel. The electrodes have end portions which are angled off from the shaft portions to face each other. A fill of mercury and noble gas, and an additive of a metal halide, is included within the vessel.

In accordance with the invention the shaft portions are straight and extend in axial direction within the lamp; and each of the end portions of the electrodes comprises a pin element which is secured to a side of the respective shaft portion. The pin element is an element separate from the shaft portion and dimensioned to have a cross-sectional area which is larger than the cross-sectional area of the shaft portion to obtain high heat capacity of the electrode, while minimizing heat transfer through the shaft portion to the pinch or press seal.

The structure in accordance with the invention has the advantage that corrosion of the electrodes is substantially decreased. It is not entirely understood why this should be so. It is believed that the high heat capacity of the pins or pin elements changes the temperature profile along the electrodes to thereby change the halogen cycle within the lamp in a direction to reduce or inhibit corrosion of the electrodes. Degradation of tungsten thus will not occur any more along the relatively cold regions of the electrode shaft in the vicinity of the pinch seal.

The heat conduction along the electrode shaft is decreased, since the diameter of the shaft wire can be much smaller than that of the pin. The time of electrical arcing up to acceptance of the arc by the electrodes also is reduced, so that the ignition characteristics of the lamp are improved. The increased heat capacity in the region of the electrode tips decreases the amplitudes of periodic temperature variation, which change with the frequency of the applied power supply, and thus decreases the re-ignition peaks.

DRAWINGS

DETAILED DESCRIPTION

Figure 1:
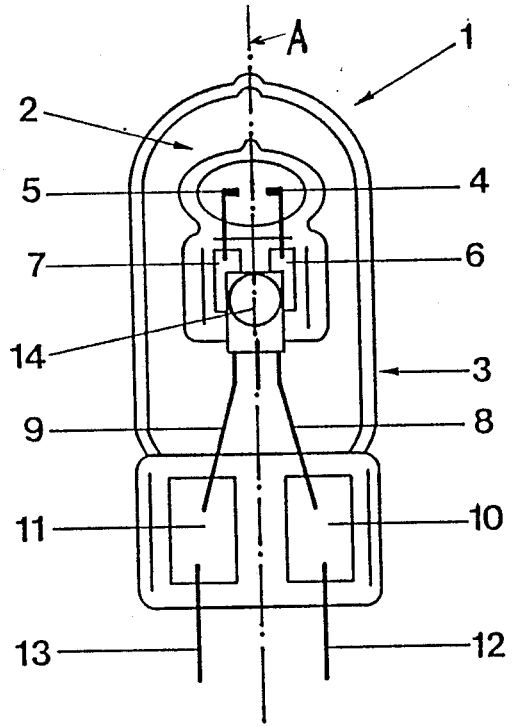
FIG. 1 is a schematic side view of a high-pressure discharge lamp in accordance with the present invention, retained within an outer bulb.

The lamp of FIG. 1, used to illustrate the present invention, is a nominal 150 W lamp. The lamp 1 has a single-ended quartz glass discharge vessel 2, closed off by a pinch or press seal. It is retained within an outer bulb 3 which, likewise, is single-ended and closed off by a pinch or press seal. The outer bulb 3 likewise is of quartz glass. The outer diameter of the lamp is about 25 mm, the overall length about 84 mm. The discharge vessel 2 has a discharge volume similar to an ellipsoid. It, therefore, defines three axes. The longitudinal or longest axis, which extends along a connection line between the tips or end portions of the electrodes 4, 5—see FIG. 1—is about 10 mm. The two smaller axes, defining the height and width of the discharge vessel, are of about equal size, each about 8 mm. The axis defining the height is herein referred to as the longitudinal axis of the lamp and shown in FIG. 1 at A. Electrodes 4, 5 are shown schematically. They are connected to foils 6, 7 to provide for a gas-tight pinch seal to the discharge vessel 2. Current supply leads 8, 9 lead to further sealing foils 10, 11 which, likewise, are retained within a pinch seal formed in the outer bulb 3. Connecting terminal lines 12, 13 connect with the foils 10, 11 for connection to a base—not shown—for example and preferably of ceramic. A wire holder to which a getter 14 is attached is likewise retained within the pinch or press seal of the discharge vessel 2, the getter 14 being located within the bulb 3. It is not connected to any other electrodes, that is, is free from electrical potential.

The discharge vessel 2 retains a fill which, in operation, is under pressure of about 35 bar. The volume of the discharge vessel 2 is 0.65 $cm^3$. Besides mercury, about 15 mg, and a noble gas, it retains metal iodides and bromides, the metals used for these iodides and bromides being sodium, tin, thallium, indium and lithium; the overall quantity is about 2.3 mg metal halide, and additionally 0.2 mg tin. At a nominal operating current of 1.8 A, light output of 83 lm/W is obtainable.

Figure 3:
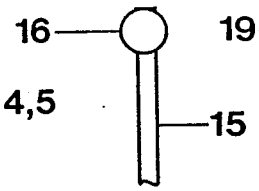
FIG. 3 is a front view of the electrode of FIG. 2.
Figure 2:
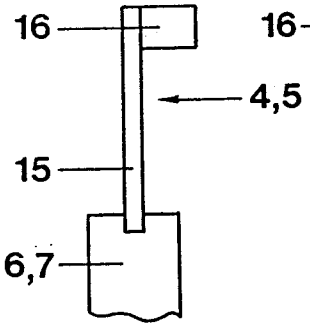
FIG. 2 is a side view of an electrode suitable for use in the lamp of FIG. 1.

In accordance with the present invention, and as best seen in FIGS. 2 and 3, the electrode of the lamp has a straight shank or shaft 15 of about 10.2 mm length, made of undoped tungsten wire. A cylindrical pin 16 is laterally secured to the end of the shaft 15 which will carry the discharge. The pin 16 is secured to the shaft 15 by butt welding, so that pin 16 and shaft 15 extend at right angle with respect to each other. The discharge extends transversely to the shafts 15, which, in the lamp, are located parallel to each other, as clearly seen in FIG. 1.

The pins 16 are located at about half the height of the discharge volume within the discharge vessel 2, so that possible influence of the burning position on the operating characteristics of the lamp is minimized.

The pin 16 is a tungsten wire, enriched with 0.7% of thorium-dioxide. Emitter pastes are not necessary. The two pins 16—see FIG. 1—are coaxial with respect to each other and each have a length of 1.2 mm and a diameter of 1.2 mm. The electrodes are spaced from each other by about 6–7 mm, which is more than half of the length of the longitudinal axis of 10 mm of the discharge vessel 2.

Two types of lamps can be made in this way. Type I has pins of 1.2 mm diameter and shaft wires 15 of 0.6 mm diameter. In type II, the diameter of the pins 16 is only 0.9 mm, the length, as before, is 1.2 mm, and the shaft wire 15 is slightly thinner, about 0.5 mm.

The pin 16 may be a wire element, but can be made of a sinter body which is press-formed of doped tungsten powder, and welded to the end of the shaft 15.

COMPARATIVE OPERATING DATA

Comparing the operating characteristics of lamps of the present invention with lamps of the prior art, in which the shaft and the electrode tips have the same dimension, but which, otherwise, are identical in construction, shows the following:

Using electrodes with pins 16 of high heat capacity results in substantial decrease of electrode corrosion. In lamps of type I, the lifetime is increased by about 20%; in lamps of type II, the lifetime is increased by about 10%, both with respect to conventional lamps.

The ignition characteristics and the ease of ignition are defined by the voltage ratio of $U_W/U_B$, wherein $U_W$ defines the re-ignition voltage and $U_B$ the operating voltage of the lamp. The acceptance of the arc increases as this ratio decreases.

Lamps with the electrodes with the tip or pin of type I have, as can be expected, improved ignition characteristics with respect to lamps of conventional, angled electrodes. In lamps of type I, the ratio $U_W/U_B$ is 1.60; lamps with conventionally angled-off electrodes have a similar ratio of 1.80. Lamps, in which the electrodes are formed in accordance with the above-described type II, have even better ignition characteristics, with a ratio $U_W/U_B$ of 1.56; however, corrosion resistance is not as good as in the lamps of type I, that is, the improvement in lifetime obtained with respect to prior art lamps is not as marked.

The structure can be used also with lamps of much smaller power rating. For example, in a high-pressure discharge lamp of 35 W nominal power, the general construction will be essentially as shown in FIG. 1; the ellipsoidal discharge vessel, however, has substantially smaller dimensions, and all three axes have different dimensions, namely:

longitudinal axis: 5 mm
transverse axis, or width: 4 mm
vertical axis, or internal height: 3.5 mm
volume of discharge vessel: 0.07 $cm^3$.

The composition of the fill of the discharge vessel is similar, except that bromine is replaced by iodine, and an additional excess of tin is used.

This lamp, also, has similarly increased operating characteristics as the lamp described in detail above.

Figure 4:
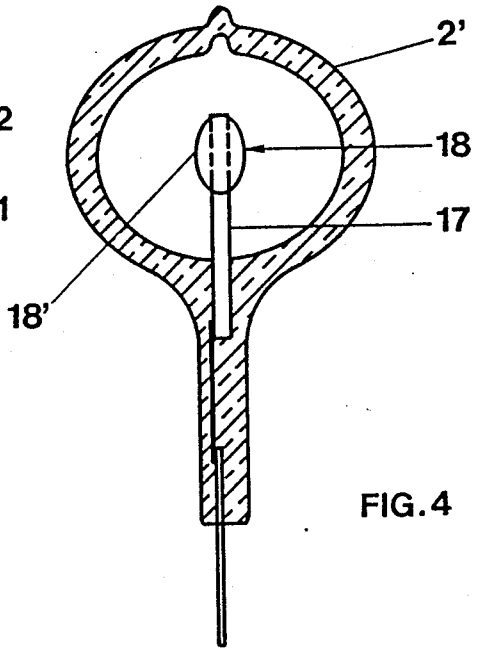
FIG. 4 is a front view of another form of the electrode, retained within a typical discharge vessel.

FIG. 4 shows a half-front view of the 35 W lamp, so that the electrode can be seen. The pin element 18 is somewhat matched to the approximately ellipsoidal discharge vessel 2', by deforming the circular cross section of the pin. The longitudinal side portion 18' of the cross-sectional surface of the pin 18 has a higher heat radiation than the transverse side. The pin is thus so located on the electrode shaft 17 that the longer side 18' of the pin is directed towards the further removed, and hence colder, inner wall, that is, the wall portion which corresponds to the transverse axis of the discharge vessel 2', that is, the axis having the dimension of about 4 mm. Specifically, the straight shank 17 is made of undoped tungsten wire with a wire diameter of 0.3 mm. Its length is 6.6 mm. The pin 18 is made of tungsten, enriched with 0.7% $ThO_2$. Percentages, as before, are by weight. The pin 18 has a length of 0.7 mm, a width of 0.6 mm, and a flattened height 18' of 0.55 mm. FIG. 4 is drawn distortedly to illustrate the principle, and not to scale.

The flattened or oval cross section of the pin 18 can be easily obtained by starting with a circular wire and subsequently rolling the wire or drawing it through a suitably shaped oval die. When using a sintered pin, the mold for sintering may have already the desired shape. In general, an increased non-homogeneity of heat radiation can be obtained thereby.

Figure 5B:
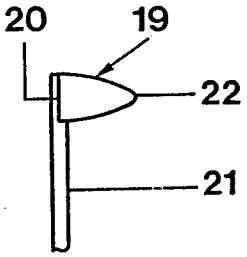
FIGS. 5*a* and 5*b* are, respectively, a front view and a side view of another embodiment of the electrode.
Figure 5A:
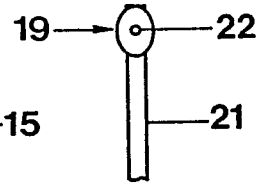

FIGS. 5*a* and 5*b* illustrate electrode tips made of sintered material, as sinter bodies. Such sinter bodies permit increase of the heat radiation towards the dead space behind the electrodes, if the electrode vessel has its coldest spot at those regions. Preferably, the sinter body 19 is ellipsoidal conically, or in form of a pyramid. The sinter body 19 has a roughly elliptical base surface 20, with a longitudinal axis along the electrode shaft 21 and a transverse axis extending right and left in FIG. 5a. The thickness of the electrode shaft 21 is less than the length of the transverse axis, the sinter body being welded to the shaft 21. The tip 22 of the sinter body 19 is rounded, to start the arc discharge. The base surface 20 which extends beyond the shaft 21, transverse to the discharge, heats the dead space behind the electrode.

The color temperature and the color indices of the light obtained can be controlled and changed by suitable selections of metals and halides, and other metals and halides than those referred to can be used. For example, using a fill with sodium iodide and thallium iodide as well as iodides of several rare earth metals (Dy, Ho, Tm) results in a higher color temperature. The exact dimension of the pin element 16, 18, 19, respectively, depends on the geometry of the discharge vessel and the power rating of the lamp. A compromise must be made between reducing electrode corrosion and good ignition characteristics, considering, also, the composition of the lamp fill. Lamp fill composition is very important. The electrode dimensions are matched to the respective fill system.

A particularly desirable relationship between high heat capacity at the electrode tip, that is, in the region of the pin element 16, 19, and low heat conduction along the electrode shaft, can be obtained by using a pin element with circular cross section, see FIG. 3, and especially if the relationship of the diameter of the pin with respect to the shaft is such that the diameter of the pin 16 is greater by a factor of between 1.5 to 3 than the diameter of the shaft 15. The relationship between length to diameter of the pin 16 is between 1 and 2.

Various changes and modifications may be made; the concept of the present invention permits targeted influence and optimization of the most important operating parameters which arise in the operation of single-ended metal halide discharge lamps, and particularly such lamps which have an outer bulb 3. The laterally extending surface of the pin, due to the substantially larger cross-sectional surface of the pin with respect to the shaft, increases heat radiation into the regions of the discharge vessel behind the electrodes, so that the temperature distribution within the discharge vessel is rendered more uniform.

In prior art, both the tip and shaft of the electrode were often made from a single piece of wire. This wire was doped with substances having a low electron emission work function, usually $ThO_2$. A quite small amount of $ThO_2$ was desirable so that the color spectrum of the lamp was not adulterated. Using a pin which is separate from the shaft permits doping of the electrode tips only, and more effectively prevents improper operation of the lamp. Such improper operation may occur by formation of the arc between the electrode shafts in the vicinity of the pinch seal. In the prior art, the unavoidable doping of the shaft contributed to this malfunction. Thus, more reliable ignition and operation can be obtained by making the pin 16, 18, 19 of thoriated tungsten, while making the shaft 15, 17, 21 of undoped tungsten wire.

The electrode structure in the lamp is particularly suitable for use with lamps having discharge vessels in which, due to the geometric relationship, the lateral distance of the electrode tips to the inner wall of the discharge vessel is substantially different in different directions, that is, height and width. This is the case when the discharge vessel is ellipsoidal or approximately ellipsoidal. Such lamps are frequently used as projection lamps. In an arrangement in accordance with the invention, as best shown in FIGS. 5a and 5b, the shape of the cross-sectional area of the pin is so selected that the heat radiation in different spatial directions is different, and so targeted that the different spacing to the inner walls of the discharge vessel can be considered. The electrode pin can be easily made either as a wire element, or as a sinter body, having essentially oval cross section, see FIGS. 4 and 5a.

The corrosion-reducing effect of the pin is particularly noticeable in lamps having fills with additives of high chemical aggression with respect to the components. This is particularly the case with respect to tin halides. Tin halides are desirable to obtain a warm light color output.

Various changes and modifications may be made, and features described in connection with any one of the embodiments may be used with any of the others, within the scope of the inventive concept.

We claim:

1. Single-ended high-pressure low-power discharge lamp, particularly of a power rating in the order of up to about 150 W, having
   - a discharge vessel (2) of quartz glass defining a longitudinal axis (A)
   - a pair of electrodes (4, 5) extending into said vessel and having
     - generally parallel shaft portions (15,17, 21) extending in a direction parallel to the longitudinal axis (A) of the discharge vessel (2) and sealed into a pinch or press seal of the vessel, and leading into the interior of said vessel, and
     - electrode end portions, angled off by about 90° from said shaft portions and facing each other; and
   - a fill of mercury, a noble gas, and an additive comprising a metal halide for controlling the color temperature of the light emission during operation of the lamp,
   - said metal halide being present in the discharge vessel in a quantity which causes, during operation of the lamp, dissociating in a halogen cycle, and attacking the lamp electrodes,
   - comprising, in accordance with the invention,
   - means for reducing corrosive effects of the metal halide component of the fill on the shaft portions (15, 17, 21) of the electrodes during operation of the lamp, including
   - a pin element (16, 18, 19) separate from said shaft portions and forming said electrode end portions secured to a side of the respective shaft portions (15, 17, 21), said pin elements being dimensioned to have a cross-sectional area at least in the region of the respective shaft portions which is larger than the cross-sectional area of the respective shaft portions (15, 17, 21) to provide high heat capacity of the electrodes at said end portions and affect the halogen cycle within the lamp during operation thereof and minimize heat transfer to the pinch or press seal via the shaft portions.

2. The lamp of claim 1, wherein (FIGS. 1, 2, 3) the pin element (16) has a circular cross section.

3. The lamp of claim 1, wherein (FIGS. 4, 5a, 5b) the pin element (18, 19) has an elongated or generally elliptical cross section.

4. The lamp of claim 2, wherein the pin element comprises a wire element.

5. The lamp of claim 3, wherein the pin element comprises a wire element.

6. The lamp of claim 2, wherein the pin element comprises a sinter body.

7. The lamp of claim 3, wherein the pin element comprises a sinter body.

8. The lamp of claim 2, wherein the diameter of the pin element (16) is larger than the diameter of the shaft portion by a factor between 1.5 to 3.

9. The lamp of claim 1, wherein at least one diametrical dimension of the pin element in the region adjacent the shaft portion is larger by a factor of 1.5 to 3 than the diameter of the shaft portion.

10. The lamp of claim 8, wherein the relationship between length to diameter of the pin element (16) is between 1 and 2.

11. The lamp of claim 9, wherein the relationship between length to diametrical dimension of the pin element (16) is between 1 and 2.

12. The lamp of claim 1, wherein the pin element comprises tungsten doped with a doping material having low electron emission work function; and wherein the shaft portion comprises non-doped tungsten.

13. The lamp of claim 1, further including an outer bulb (3) of quartz glass surrounding said discharge vessel (2).

14. The lamp of claim 1, wherein the discharge vessel has at least generally ellipsoidal shape; and wherein the pin element (18) has generally elongated or elliptical cross section, in which the sides parallel to the major axis of a general ellipse defining the cross section of the pin faces the region of the discharge vessel most remote from the pin element.

15. The lamp of claim 1, wherein the fill of the discharge vessel additionally includes a metal.

16. The lamp of claim 15, wherein said metal comprises tin.

17. The lamp of claim 12, wherein at least one diametrical dimension of the pin element in the region adjacent the shaft portion is larger by a factor of 1.5 to 3 than the diameter of the shaft portion.

18. The lamp of claim 17, wherein the relationship between length to diameter of the pin element (16) is between 1 and 2.

19. The lamp of claim 18, wherein the fill of the discharge vessel additionally includes a metal.

20. The lamp of claim 12, wherein the spacing of said electrodes is more than half the maximum diametrical dimension of said discharge vessel (2).

* * * * *